US006498136B2

(12) United States Patent
Rodrigues

(10) Patent No.: US 6,498,136 B2
(45) **Date of Patent: *Dec. 24, 2002**

(54) POLYMER HAVING A HYDROPHILIC BACKBONE AND HYDROPHOBIC MOIETIES AS SOIL SUSPENDING AGENT IN POWDER DETERGENTS

(75) Inventor: Klein A. Rodrigues, Signal Mountain, TN (US)

(73) Assignee: National Starch and Chemical Investment Holding Corporation, New Castle, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/274,977

(22) Filed: Mar. 23, 1999

(65) Prior Publication Data

US 2001/0002390 A1 May 31, 2001

(51) Int. Cl.[7] ..... C11D 3/37
(52) U.S. Cl. ..... 510/476
(58) Field of Search ..... 510/476, 477, 510/479

(56) References Cited

U.S. PATENT DOCUMENTS

| | | | | |
|---|---|---|---|---|
| 4,444,561 A | | 4/1984 | Denzinger et al. | 8/137 |
| 5,008,032 A | | 4/1991 | Diessel et al. | 252/174.24 |
| 5,055,217 A | * | 10/1991 | Garcia et al. | 252/94 |
| 5,147,576 A | | 9/1992 | Montague et al. | 252/174 |
| 5,212,272 A | * | 5/1993 | Sargent et al. | 526/317.1 |
| 5,281,306 A | * | 1/1994 | Kakiuchi et al. | 162/158 |
| 5,308,530 A | * | 5/1994 | Aronson et al. | 252/174.12 |
| 5,324,445 A | * | 6/1994 | Langley et al. | 252/174.12 |
| 5,536,421 A | * | 7/1996 | Hartman et al. | 8/137 |
| 5,565,145 A | | 10/1996 | Watson et al. | 510/350 |
| 5,719,117 A | | 2/1998 | Falk et al. | 510/475 |
| 5,723,434 A | | 3/1998 | Falk et al. | 510/475 |

FOREIGN PATENT DOCUMENTS

| | | | |
|---|---|---|---|
| EP | 510762 A2 | * | 10/1992 |
| PL | 158241 B2 | * | 8/1992 |
| WO | WO 97/24179 | * | 7/1997 |
| WO | WO 97/45512 | * | 12/1997 |

* cited by examiner

*Primary Examiner*—John Hardee
(74) *Attorney, Agent, or Firm*—Thomas F. Roland, Esq.

(57) ABSTRACT

A powder detergent composition which is effective for removing and dispersing organic non-polar and polar soils from fabrics in wash liquors. The powder detergent composition comprises a polymer having a hydrophilic backbone and at least one hydrophobic moiety. The hydrophilic backbone is prepared from a monomer selected from ethylenically unsaturated hydrophilic monomers, polymerizable hydrophilic cyclic monomers, and non-ethylenically unsaturated polymerizable hydrophilic monomers selected from glycerol and other polyhydric alcohols. The hydrophobic moiety is prepared from a monomer selected from siloxanes, saturated or unsaturated alkyl and hydrophobic alkoxygroups, aryl and aryl-alkyl groups. The polymers also boost the cleaning performance of hard surface and dishware detergent compositions.

7 Claims, No Drawings

POLYMER HAVING A HYDROPHILIC BACKBONE AND HYDROPHOBIC MOIETIES AS SOIL SUSPENDING AGENT IN POWDER DETERGENTS

FIELD OF THE INVENTION

This invention relates to a powder detergent composition having enhanced soil suspending properties on organic non-polar and polar soils in wash liquors which comprises a polymer having a hydrophilic backbone and hydrophobic moieties.

BACKGROUND OF THE INVENTION

Detergent formulators are faced with the task of devising products to remove a broad spectrum of soils and stains from fabrics. The varieties of soils and stains ranges from polar soils, such as proteinaceous, clay, and inorganic soils, to non-polar soils, such as soot, carbon-black, byproducts of incomplete hydrocarbon combustion, and organic soils. Detergent compositions have become more complex as formulators attempt to provide products which handle all types concurrently.

Formulators have been highly successful in developing traditional dispersants which are particularly useful in suspending polar, highly charged, hydrophilic particles such as clay. As yet, however, dispersants designed to disperse and suspend non-polar, hydrophobic-type soils and particulates have been more difficult to develop. Without wishing to be limited by theory, it is believed that the first step for dispersion formation is the adsorbance of the soil dispersing agent onto the soil of interest. For clay-like soils, the soil dispersing agent must adsorb onto a negatively charged surface. For organic particulates, the soil dispersing agent must adsorb onto a hydrophobic surface with little or no charge. Hence, for polar soils, like clay, a dispersing agent with some charge, such as charged polyacrylates, are employed. However, these charged dispersing agents have no driving force for adsorbing onto organic non-polar particulates.

U.S. Pat. No. 4,444,561 describes using copolymers prepared from 50 to 90 weight percent of a vinyl ester of $C_1$–$C_4$ aliphatic carboxylic acids, from 5 to 35 weight percent of a N-vinyl lactam, and from 1 to 20 weight percent of a monomer containing basic nitrogen capable of forming a salt or quaternized product, in detergent compositions to inhibit soil redeposition. The disadvantage of using such copolymers, however, is that they are capable of forming cations which may complex with anionic surfactants under certain wash conditions and cause a decrease in cleaning performance. In addition, the cationic copolymers may also undesirably promote fabric graying over multiple washing cycles.

U.S. Pat. No. 5,008,032 describes using copolymers prepared from $C_4$–$C_{28}$ olefins and $\alpha,\beta$-ethylenically unsaturated dicarboxylic anhydrides in detergent formulations. The disadvantage of using such copolymers, however, is that the copolymers are not water-soluble unless hydrolyzed with NaOH.

U.S. Pat. No. 5,723,434 describes a soil removal and soil resistant detergent composition containing a vinyl amide polymer which is prepared from 5 to 100 weight percent of a vinyl amide monomer and from 0 to 95 weight percent of a vinyl ester monomer. While the detergent compositions are effective for removing soil from hydrophobic articles such as polyester, such compositions are not as effective for cleaning hydrophilic substrates such as cotton.

U.S. Pat. No. 5,565,145 describes detergent compositions containing ethoxylated/propoxylated polyalkyleneamine polymers, such as poly(ethyleneimine), which provide soil dispersing properties. While the detergent compositions are effective for removing nonpolar soils, such detergent compositions are not as effective for removing polar soils.

U.S. patent application Ser. No. 09/262,566, filed Mar. 4, 1999, describes isotropic liquid detergent compositions containing a polymer having pendant acid functionality and a terminal fragment of a chain transfer agent. Such polymers are used to stabilize the isotropic liquid detergent composition and produce clear solutions by preventing phase separation.

U.S. Pat. No. 5,147,576 describes liquid detergent compositions in the form of a lamellar droplets which contain a deflocculating polymer having a hydrophilic backbone and a hydrophobic moiety. However, no mention is made of the possibility of using such polymers in powdered laundry detergents.

While liquid detergents are gaining popularity over powder detergents in the United States, powders remain more popular than liquid detergents outside the United States. Moreover, there is a trend to reduce the amount of water in the wash liquor for environmental reasons, thereby increasing the amount of dirt and soil that needs to be suspended in the wash liquor. For these reasons, there continues to be a need for a powder detergent composition which can be used to provide effective soil dispersing on organic non-polar and polar soils in wash liquors.

SUMMARY OF THE INVENTION

It has now been discovered that powder detergent compositions comprising polymers having a hydrophilic backbone and at least one hydrophobic moiety are effective for removing and dispersing organic non-polar and polar soils from fabrics in wash liquors. Furthermore, said polymers boost the cleaning performance of hard surface and dishware detergent compositions.

The present invention provides a powder detergent composition comprising at least one surfactant and builder and from about 0.1 to about 75 weight percent, based on the total weight of the powder detergent composition, of a polymer having a hydrophilic backbone and at least one hydrophobic moiety, wherein said hydrophilic backbone is prepared from at least one monomer selected from the group consisting of ethylenically unsaturated hydrophilic monomers selected from the group consisting of unsaturated acids, amides, ethers, alcohols, aldehydes, ketones and esters; polymerizable hydrophilic cyclic monomers; non-ethylenically unsaturated polymerizable hydrophilic monomers selected from the group consisting of glycerol and other polyhydric alcohols; and combinations thereof. The hydrophilic backbone may optionally be substituted with one or more amino, amine, amide, sulfonate, sulfate, phosphonate, hydroxy, carboxyl or oxide groups. The hydrophobic moiety is prepared from a monomer selected from the group consisting of siloxanes, saturated or unsaturated alkyl and hydrophobic alkoxygroups, aryl and aryl-alkyl groups, and combinations thereof, provided that said polymer does not include partially esterified copolymers of maleic anhydride or substituted maleic anhydride.

According to an additional aspect the invention provides a method for cleaning textiles comprising preparing the powder detergent composition as described above; contacting the powder detergent composition with one or more textiles wherein at least one of the textiles contains soil; and removing at least a portion of the soil from the textile containing soil.

DESCRIPTION OF THE INVENTION

This invention provides a powder detergent composition which contains at least one surfactant and builder and from about 0.1 to about 75 weight percent, based on the total weight of the powder detergent composition, of a polymer having a hydrophilic backbone and at least one hydrophobic moiety. Preferably, the powder detergent composition contains from about 0.5 to about 25 weight percent, more preferably from about 1 to about 10 weight percent of the polymer.

The polymer having a hydrophilic backbone and at least one hydrophobic moiety comprises a hydrophilic "backbone" component. The hydrophilic backbone may be linear or branched and is prepared from at least one ethylenically unsaturated hydrophilic monomer selected from unsaturated acids preferably $C_1$–$C_6$ acids, amides, ethers, alcohols, aldehydes, ketones and esters; polymerizable hydrophilic cyclic monomers; and non-ethylenically unsaturated polymerizable hydrophilic monomers selected from glycerol and other polyhydric alcohols. Combinations of hydrophilic monomers may also be used. Preferably the hydrophilic monomers are sufficiently water soluble to form at least a 1% by weight solution in water.

Preferably the ethylenically unsaturated hydrophilic monomers are mono-unsaturated. Examples of ethylenically unsaturated hydrophilic monomers are, for example, acrylic acid, methacrylic acid, ethacrylic acid, alpha-chloro-acrylic acid, alpha-cyano acrylic acid, beta methyl-acrylic acid (crotonic acid), alpha-phenyl acrylic acid, beta-acryloxy propionic acid, sorbic acid, alpha-chloro sorbic acid, angelic acid, cinnamic acid, p-chloro cinnamic acid, beta-styryl acrylic acid (1-carboxy-4-phenyl butadiene-1,3), itaconic acid, maleic acid, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, vinyl phosphonic acid, 2-hydroxy ethyl acrylate, tri methyl propane triacrylate, sodium methallyl sulfonate, sulfonated styrene, allyloxybenzenesulfonic acid, dimethylacrylamide, dimethylaminopropylmethacrylate, diethylaminopropylmethacrylate, vinyl formamide, vinyl acetamide, polyethylene glycol esters of acrylic acid and methacrylic acid and itaconic acid, vinyl pyrrolidone, and vinyl imidazole. Combinations of ethylenically unsaturated hydrophilic monomers may also be used. Preferably, the ethylenically unsaturated hydrophilic monomer is selected from acrylic acid, maleic acid, and itaconic acid.

The polymerizable hydrophilic cyclic monomers may have cyclic units that are either unsaturated or contain groups capable of forming inter-monomer linkages. In linking such cyclic monomers, the ring-structure of the monomers may either be kept intact, or the ring structure may be disrupted to form the backbone structure. Examples of cyclic units are sugar units such as saccharides and glucosides, cellulose ethers, glycerols, and alkoxy units such as ethylene oxide and propylene oxide.

The hydrophilic backbone of the polymer may optionally be substituted with one or more amino, amine, amide, sulfonate, sulfate, phosphonate, hydroxy, carboxyl or oxide groups. The hydrophilic backbone of the polymer may also contain small amounts of relatively hydrophobic units, for example, units derived from polymers having a solubility of less than 1 g/l in water, provided that the overall solubility of the polymer in water at ambient temperature and at a pH of 3.0 to 12.5 is more than 1 g/l, more preferably more than 5 g/l, and most preferably more than 10 g/l. Examples of relatively water insoluble polymers are polyvinyl acetate, polymethyl methacrylate, polyethyl acrylate, polyethylene, polypropylene, and polyhydroxy propyl acetate.

The polymers can be linked by any possible chemical link, although the following types of linkages are preferred:

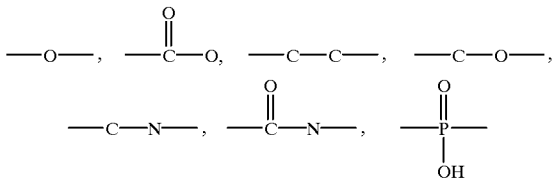

Preferably the hydrophobic moieties are part of a monomer unit which is incorporated in the polymer by copolymerising hydrophobic monomers and the hydrophilic monomers making up the backbone of the polymer. The hydrophobic moieties for this use preferably include those which when isolated from their linkage are relatively water insoluble, i.e. preferably less than 1 g/l more preferred less than 0.5 g/l, most preferred less than 0.1 g/l of the hydrophobic monomers, will dissolve in water at ambient temperature and a pH of 3.0 to 12.5.

Preferably the hydrophobic moieties are selected from siloxanes, saturated and unsaturated alkyl chains, e.g. having from 5 to 24 carbon atoms, preferably from 6 to 18, most preferred from 8 to 16 carbon atoms, and are optionally bonded to the hydrophilic backbone via an alkoxylene or polyalkoxylene linkage, for example a polyethoxy, polypropoxy or butyloxy (or mixtures of same) linkage having from 1 to 50 alkoxylene groups. Alternatively the hydrophobic moiety may be composed of relatively hydrophobic alkoxy groups, for example butylene oxide and/or propylene oxide, in the absence of alkyl or alkenyl groups. In some forms, the hydrophobic moieties will essentially have the character of a nonionic surfactant.

Examples of hydrophobic monomers include styrene, α-methyl styrene, 2-ethylhexyl acrylate, octylacrylate, lauryl acrylate, stearyl acrylate, behenyl acrylate, 2-ethylhexyl methacrylate, octylmethacrylate, lauryl methacrylate, stearyl methacrylate, behenyl methacrylate, 2-ethylhexyl acrylamide, octylacrylamide, lauryl acrylamide, stearyl acrylamide, behenyl acrylamide, propyl acrylate, butyl acrylate, pentyl acrylate, hexyl acrylate, 1-vinyl naphthalene, 2-vinyl naphthalene, 3-methyl styrene, 4-propyl styrene, t-butyl styrene, 4-cyclohexyl styrene, 4-dodecyl styrene, 2-ethyl-4-benzyl styrene, and 4-(phenylbutyl) styrene. Combinations of hydrophobic monomers may also be used.

In one embodiment, the polymers of the invention are represented by Structure (I) as follows:

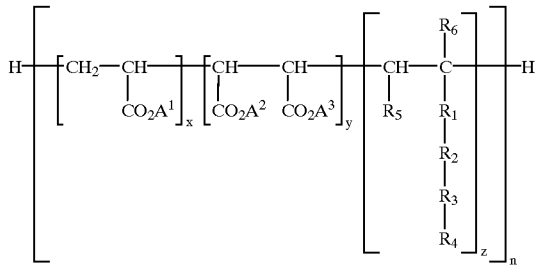

wherein z is 1;

(x+y):z is from 0.1:1 to 1,000:1, preferably from 1:1 to 250:1; in which the monomer units may be in random order;

y is from 0 to a maximum equal to the value of x; and n is at least 1;

$R_1$ is selected from the group consisting of —CO—O—, —O—, —O—CO—, —$CH_2$—, and —CO—NH— or is absent;

$R_2$ is from 1 to 50 independently selected alkyleneoxy groups, preferably ethylene oxide or propylene oxide groups, or is absent, provided that when $R_3$ is absent and $R_4$ is H or contains no more than 4 carbon atoms, then $R_2$ is an alkyleneoxy group with at least 3 carbon atoms;

$R_3$ is a phenylene linkage, or is absent;

$R_4$ is H or a $C_1$–$C_{24}$ alkyl or $C_2$–$C_{24}$ alkenyl group, provided that a) when $R_1$ is —O—CO— or —CO—O— or —CO—NH—, $R_2$ and $R_3$ are absent and $R_4$ has at least 5 carbon atoms;

b) when $R_2$ is absent, $R_4$ is not H and when $R_3$ is absent, then $R_4$ has at least 5 carbon atoms;

$R_5$ is H or —$COOA^4$;

$R_6$ is H or a $C_1$–$C_4$ alkyl; and $A^1$, $A^2$, $A^3$, and $A^4$ are independently selected from the group consisting of H, alkali metals, alkaline earth metals, ammonium bases, amine bases, and $C_1$–$C_4$alkyl.

In one embodiment, the polymers of the invention are represented by Structure (II) as follows:

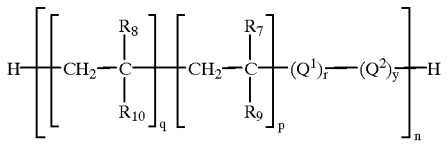

wherein $Q^2$ has the Structure (IIa) as follows:

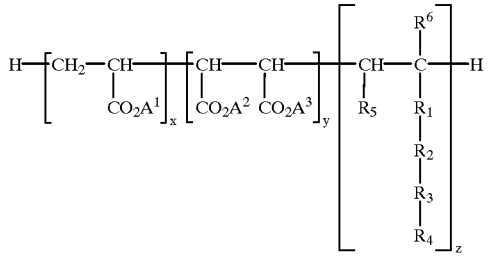

wherein z and $R_1$–$R_6$ are as defined for Structure (I);

$A^1$–$A^4$ are as defined for Structure (I) or $(C_2H_4O)_tH$, wherein t is from 1–50, and wherein the monomer units may be in random order;

$Q^1$ is a multifunctional monomer, allowing the branching of the polymer, wherein the monomers of the polymer may be connected to $Q^1$ in any direction or order, therewith possibly resulting in a branched polymer, preferably $Q^1$ is selected from trimethyl propane triacrylate (TMPTA), methylene bisacrylamide or divinyl glycol; n and z are as defined above;

r is 1; and (x+y+p+q+r):z is from 0.1:1 to 1,000:1, preferably from 1:1 to 250:1; in which the monomer units may be in random order; and preferably either p and q are zero, or r is zero;

$R_7$ and $R_8$ are independently —$CH_3$ or —H;

$R_9$ and $R_{10}$ are independently substituent groups selected from the group consisting of amino, amine, amide, sulfonate, sulfate, phosphonate, phosphate, hydroxy, carboxyl and oxide groups, preferably —$SO_3Na$, —CO—O—$C_2H_4$—$OSO_3Na$, —CO—O—NH—C$(CH_3)_2$—$SO_3Na$, —CO—$NH_2$, —O—CO—$CH_3$, and —OH.

In one embodiment, the polymers of the invention are represented by Structure (III) as follows:

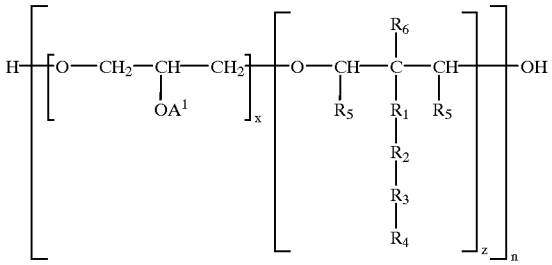

wherein x is from 4 to 1,000, preferably from 6 to 250;

n is 1, z and $R_1$–$R_6$ are as defined in Structure (I), wherein the monomers units may be in random order;

$A^1$ is as defined above for Structure (I) or —CO—$CH_2$—C(OH)$CO_2A^1$–$CH_2$—$CO_2A^1$, or may be a branching point wherein other molecules of Structure (III) are attached.

Examples of molecules having Structure (III) are hydrophobically modified polyglycerol ethers or hydrophobically modified condensation polymers of polyglycerol and citric acid anhydride.

In one embodiment, the polymers of the invention are represented by Structure (IV) as follows:

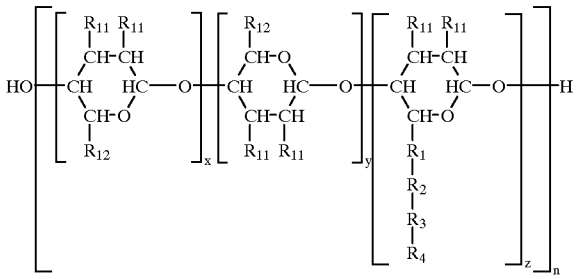

wherein z, n and $A^1$ are as defined for Structure (I), (x+y):z is from 0.1:1 to 1,000 to 1, preferably from 1:1 to 250:1; wherein the monomer units may be in random order;

$R^1$ is as defined above for Structure (I) or $R_1$ is selected from —$CH_2$—O—, —$CH_2$—O—CO—, and —NH—CO—; $R_2$–$R_4$ are as defined in Structure (I);

$R_{11}$ is selected from the group consisting of —OH, —NH—CO—$CH_3$, —$SO_3A^1$ and —$OSO_3A^1$;

$R_{12}$ is selected from the group consisting of —OH, —$CH_2OH$, —$CH_2OSO_3A^1$, $COOA^1$, and —$CH_2$—$OCH_3$.

Examples of molecules having Structure (IV) are hydrophobically modified polydextran, -dextran sulfonates, -dextran sulfates and lipoheteropolysaccharides.

In one embodiment, the polymers of the invention are represented by Structure (V) as follows:

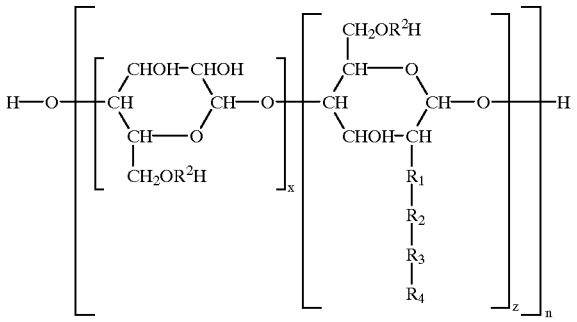

wherein:

z, n and $R_1$–$R_6$ are as defined above for Structure (I); and x is as defined for Structure (III).

In one embodiment, the polymers of the invention are hydrophobically modified condensation polymers of -hydroxy acids. Examples of suitable polymer backbones are polytartronate, polycitrate, polyglyconate, and mixtures thereof. In another embodiment, the polymers of the invention are hydrophobically modified polyacetals.

In any particular sample of polymer materials in which polymers of the above Structures are in the form of a salt, usually, some polymers will be full salts ($A^1$–$A^4$ all other than hydrogen), some will be full acids ($A^1$–$A^4$ all hydrogen) and some will be part-salts (one or more of $A^1$–$A^4$ hydrogen and one or more other than hydrogen).

The salts of the polymers of the above formulas may be formed with any organic or inorganic cation defined for $A^1$–$A^4$ and which is capable of forming a water-soluble salt with a low molecular weight carboxylic acid. Preferred are the alkali metal salts, especially of sodium or potassium.

It is within the scope of the invention to use the polymer having a hydrophilic backbone and hydrophobic moiety in liquid detergents.

The polymers of the present invention are prepared by processes known in the art such as disclosed in U.S. Pat. No. 5,147,576. Preferably, the polymers are prepared using conventional aqueous polymerization procedures, but employing a process wherein the polymerization is carried out in the presence of a suitable cosolvent and wherein the ratio of water to co-solvent is carefully monitored so as to maintain the ratio of water to cosolvent equal or greater than unity during the reaction, thereby keeping the polymer, as it forms, in a sufficiently mobile condition and to prevent unwanted homopolymerization of the hydrophobic monomer and subsequent undesired precipitation thereof.

The polymers of the invention having a hydrophilic backbone and hydrophobic moieties when used in a powder laundry detergent exhibit enhanced soil suspending properties on organic non-polar and polar soils in wash liquors. Typically such laundry detergents are manufactured by a spray drying process in which surfactants and builders are incorporated into an aqueous crutcher slurry fed into a spray tower. Such processes are ideal for obtaining fluffy, light-density powders (approximately 0.3 g/$cm^3$).

In another embodiment, the powder detergent composition is manufactured in more compact powder detergents which involves removal of inert fillers, control of spray drying to minimize porosity of powder granules, minimization of occluded volumes within both powder granules and the packed powder bed, and reformulation on the basis of the most volume-efficient materials. Compact powders also offers increased opportunities to utilize a wider range of processing techniques. Low-active aqueous solutions can be conveniently used in spray tower processes. In contrast, high-active surfactant forms are required for agglomeration and dry blending.

In another embodiment, the powder detergent compositions are prepared by dry blending which refers to the direct blending of dry powder ingredients. Although the process is quite simple in nature and can produce high-density products, the restrictions for dry forms of surfactant such as powders or flakes severely limits the usefulness of this technique for manufacture of compact detergent powders. In addition, component segregation can occur due to the varying densities of the ingredients. Bulk densities 0.6 g/$cm^3$ are also easily achieved by agglomeration processes. Agglomeration processes, although more complex than drying blending, require less capital investment and are also much less energy intensive than spray-drying. In this case, liquid silicates and/or liquid surfactants such as alcohol ethoxylates act as the agglomeration agent to hold the builder particles together and increase particle size. Various types of agglomeration equipment are available to allow efficient mixing of the liquid and powder ingredients.

In another embodiment, combination processes are used to prepare the powder detergent composition in the form of a compact powder. For example, liquid nonionic surfactants can be sprayed onto spray-dried powders containing only builder or builder and anionic surfactant. By filling the voids within the spray-dried bead, the liquid surfactant, such as alcohol ethoxylate, increases the density of the final product. Similarly, increased density and improved powder flow properties have been reported for a detergent produced by first coating a spray-dried base powder with zeolite followed by spraying with a nonionic surfactant. Higher densities approaching 1.0 g/cm$^3$ are achieved when the spray-dried powder is compressed and then extruded in the presence of non-ionic surfactant. New processes in which fluid bed drying is incorporated long with the spray dryer and agglomerator have also been developed which provide greater flexibility in density and composition.

Examples of surfactants useful in the powder detergent compositions herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{18}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Builders used in the powder detergent compositions include organic and inorganic builders. The level of builder can vary widely depending upon the end use of the composition and its desired physical form. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulfates, and aluminosilicates. However, non-phosphate builders are required in some locales. The detergent compositions function well in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.1:1 to 3.2:1 and layered silicates. NaSKS-6 is the trademark for a crystalline layered silicate marketed by Hoechst. Unlike zeolite builders, the Na SKS-6 silicate builder does not contain aluminum. NaSKS-6 has the delta-$Na_2$ $SiO_5$ morphology form of layered silicate. Other layered silicates, such as those having the general formula $NaMSi_xO_{2x+1y}H_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. Other silicates may also be useful such as for example magnesium silicate, which can serve as a crispening agent in granular formulations, as a stabilizing agent for oxygen bleaches, and as a component of suds control systems.

Aluminosilicate builders are useful in the present invention. Aluminosilicate builders are important in most currently marketed heavy duty granular detergent compositions. Aluminosilicate builders include those having the formula:

$$M_z[(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Additional builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt) can also be used in granular compositions, especially in combination with zeolite and/or layered silicate builders. Oxydisuccinates are also especially useful in such compositions and combinations.

Also suitable in the detergent compositions of the present invention are the 3,3-dicarboxy4-oxa-1,6-hexanedioates and related compounds. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates.

The powder detergent compositions may include one or more enzymes. Such enzymes include, for example, lipases, proteases, amylases, peroxidases and the like which are well known in the art. The enzymes may be used together with cofactors required to promote enzyme activity. It should also be understood that enzymes having mutations at various positions (e.g., enzymes engineered for performance and/or stability enhancement) are also contemplated by the invention. Enzymes are normally incorporated at levels sufficient to provide up to about 5 mg by weight, more typically about 0.01 mg to about 3 mg, of active enzyme per gram of the composition.

The detergent compositions may optionally contain bleaching agents or bleaching compositions containing a bleaching agent and one or more bleach activators when formulated appropriately by those skilled in the art. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Highly preferred bleaching agents also include 6-nonylamino-6-oxoperoxycaproic acid.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. The nonanoyloxybenzene sulfonate (NOBS) and tetraacetyl ethylene diamine (TAED) activators are typical, and mixtures thereof can also be used. Bleaching agents other than oxygen bleaching agents are also known in the art and can be utilized herein.

The powder detergent compositions may further comprise at least one additive. Suitable additives may include, for example, dye transfer inhibitors, anticorrosion materials, antistatic agents, optical brighteners, perfumes, fragrances, dyes, fillers, chelating agents, fabric whiteners, brighteners, sudsing control agents, buffering agents, soil release agents, fabric softening agents, and combinations thereof. In general, such additives and their amounts are known to those skilled in the art.

The following nonlimiting examples illustrate further aspects of the invention.

EXAMPLE 1

Preparation of polymer containing 33.3 mole % acrylic acid and 66.7 mole % styrene.

An initial charge of 140 g of deionized water and 240 g of isopropyl alcohol was added to a 1 liter glass reactor fitted with a lid having inlet ports for an agitator, water cooled condenser and for the addition of monomer and initiator solutions. The reactor contents were heated to reflux (approximately 86° C.). At reflux, continuous additions of 103 g of acrylic acid, 297 g of styrene and 1 g of dodecylmercaptan (DDM), were added to the reactor concurrently with stirring over a period of 3 hours. During the same time period and for 30 additional minutes, the following initiator solutions were added to the reactor:

| | |
|---|---|
| Initiator Solution #1 | |
| t-butyl hydroperoxide | 40 g |
| Isopropyl alcohol | 20 g |
| Deionized water | 20 g |
| Initiator Solution #2 | |
| sodium formaldehyde sulphoxylate | 16 g |
| Deionized water | 80 g |

At the end of the initiator addition, a 47% aqueous sodium hydroxide solution (100 g) was added to yield a polymer solution having a final pH of approximately 7 to 8. The reaction temperature was maintained at reflux for a further 1 hour to eliminate any unreacted monomer.

After the 1 hour hold the alcohol co-solvent was removed from the polymer solution by azeotropic distillation under vacuum. During the distillation, deionized water was added to the polymer solution to maintain a reasonable polymer viscosity.

Once the distillation stage was completed, the aqueous solution of the copolymer was cooled to less than 30° C.

EXAMPLE 2

Preparation of polymer containing 60 mole % acrylic acid and 40 mole % styrene.

An initial charge of 86.4 g of deionized water, 79.2 g of isopropyl alcohol, and 0.042 grams of ferrous ammonium sulfate was added to a 1 liter glass reactor. The reactor contents were heated to reflux (approximately 84° C.).

At reflux, continuous additions of 64.5 g of acrylic acid, 62.1 g of styrene, 0.1 g of dodecylmercaptan, were added over a period of 3.5 hours. The initiator and chain transfer solutions were added at the same time as the above described monomer solution over a period of 4 hours and 3.25 hours, respectively.

| Initiator solution | |
|---|---|
| Sodium persulfate | 5.72 g |
| Water | 14.0 g |
| Hydrogen peroxide 35% | 16.7 g |
| Chain transfer solution | |
| 3-mercapto propionic acid, 99.5% | 4.9 g |
| water | 21.8 g |

After adding the initiator and chain transfer solutions, the reaction temperature was maintained at about 88° C. for one hour. The alcohol co-solvent was removed from the polymer solution by azeotropic distillation under vacuum. During the distillation, a mixture of 144 g of deionized water and 64.1 g of a 50% sodium hydroxide solution was added to the polymer solution. A small amount of ANTIFOAM 1400 (0.045 g) was added to suppress any foam generated during distillation. Approximately, 190 g of a mixture of water and isopropyl alcohol were distilled off. After distillation was completed, 25 g of water was added to the reaction mixture which was cooled to obtain a yellowish amber solution.

EXAMPLE 3

Preparation of polymer containing 96.1 mole % acrylic acid and 3.9 mole % laurylmethacrylate.

An initial charge of 190 g of deionized water and 97.1 g of isopropyl alcohol was added to a 1 liter glass reactor. The reactor contents were heated to reflux (approximately 82° C.–84° C.). At reflux continuous additions of 105 g of acrylic acid, and 15.0 g of laurylmethacrylate were added to the reactor concurrently over a 3 hour period of time with stirring. Concurrently, an initiator solution containing 15.9 g of sodium persulfate and 24.0 g of water was added over a period of 4 hours.

The reaction temperature was maintained at 82° C.–85° C. for an additional hour. The alcohol co-solvent was removed from the polymer solution by azeotropic distillation under vacuum. During the half way point of the distillation (when approximately 100 g of distillate is producted), 48 g of hot water was added to the polymer solution to maintain a reasonable polymer viscosity. A small amount of Antifoam 1400 (0.045 g) was added to suppress any foam that may be generated during distillation. Approximately, 200 g of a mixture of water and isopropyl alcohol was distilled off. The distillation was stopped when the isopropyl alcohol level in the reaction product was less than 0.3 weight percent.

The reaction mixture was cooled to less than 40° C. and 45 g of water and 105.8 g of a 50% NaOH was added to the reaction mixture with cooling while maintaining a temperature of less than 40° C. to prevent hydrolysis of the laurylmethacrylate. The final product was an opaque viscous liquid.

EXAMPLE 4

Evaluation of anti-redeposition properties.

The polymers prepared in Examples 2 and 3 were evaluated in a detergent composition for antiredeposition properties and compared to a detergent composition without the polymer. The anti-redeposition test was conducted in a terg-o-tometer using three 4×4.5" cotton swatches and three 4×4.5" EMPA 213 (polycotton swatches available from Test Fabrics). Five 4×4" polycotton swatches were used as ballast. The wash cycle was 10 minutes using 1.4 g/l of powder detergent (composition listed below) and 150 ppm hardness water with a Ca to Mg ratio of 2:1. The soil used was 0.3 g/L rose clay, 0.16 g/L bandy black clay and 0.9 g/L of an oil blend (70% vegetable oil and 30% mineral oil). The polymer and copolymers were dosed at 1 or 2 weight percent of the detergent weight. The rinse cycle was 3 minutes using 150 ppm hardness water with a Ca to Mg ratio of 2:1. A total of three wash, rinse, and dry cycles were carried out. The drying was done in a tumble dryer on medium setting. The L a b values before the first cycle and after the third cycle was measured as $L_1$, $a_1$, $b_1$ and $L_2$, $a_2$, $b_2$ respectively.

$$\Delta E=[(L_1-L_2)^2+(a_1-a_2)^2+(b_1-b_2)^2]^{0.5}$$

The powder detergent was prepared as follows: 100 g of Zeolite A (Valfor 100 from Crossfield), 40 g of sodium carbonate, 100 g of a 40% sodium silicate solution, 16 g of NEODAL 25-7 from Shell Chemical, 90 g of dodecylbenzene sodium sulfonate (COLONIAL 1240 from Colonial Chemical) and 176.8 grams of sodium sulfate was mixed together using a mortar and pestle till a free flowing homogenous powder was obtained. The test results are summarized in Table I.

TABLE I

Soil Suspension Test

| Polymer | ΔE for cotton | Ave ΔE for cotton | Ave ΔE for polycotton | Ave ΔE for polycotton |
|---|---|---|---|---|
| Blank | 3.22 | | 1.52 | |
| | 3.24 | 3.15 | 1.53 | 1.52 |
| | 3.0 | | 1.51 | |
| Polymer of Example 2 | 1.48 | | 0.54 | |
| at 1 wt % of detergent | 1.28 | 1.33 | 0.69 | 0.62 |
| | 1.25 | | 0.62 | |
| Polymer of Example 2 | 1.27 | | 0.65 | |
| at 2 wt % of detergent | 1.39 | 1.32 | 0.72 | 0.71 |
| | 1.30 | | 0.75 | |
| Polymer of Example 3 | 1.52 | | 0.66 | |
| at 1 wt % of detergent | 1.81 | 1.66 | 0.71 | 0.69 |
| | 1.66 | | 0.71 | |
| Polymer of Example 3 | 1.30 | | 0.66 | |
| at 2 wt % of detergent | 1.29 | 1.26 | 0.73 | 0.70 |
| | 1.18 | | 0.70 | |

The test results in Table I clearly show that powder detergent compositions containing the polymers prepared in Examples 2 and 3 suspend significantly more clays (polar non-organic soils) and oils (non-polar organic soils) as compared to powder detergent compositions without the polymers of the invention.

While the invention has been described with particular reference to certain embodiments thereof, it will be understood that changes and modifications may be made by those of ordinary skill within the scope and spirit of the following claims.

What is claimed is:

1. A powder detergent composition consisting of a) anionic surfactants, non-ionic surfactants, amphoteric surfactants, or mixtures thereof;

b) builder;

c) from 0.1 to 75 weight percent, based on the total weight of the powder detergent composition, of a polymer having a hdrophilic backbone and at least one hydrophobic moiety, wherein said hydrophilic backbone is prepared from one monomer selected from the group consisting of unsaturated $C_1$–$C_6$ acids, and esters, wherein said hydrophilic backbone is optionally substituted with one or more amino, amine, amide, sulfonate, sulfate, phosphonate, hydroxy, carboxyl or oxide groups; wherein said hydrophobic moiety is prepared from a monomer selected from the group consisting of siloxanes, saturated or unsaturated alkyl and hydrophobic alkoxy groups, aryl and aryl-alkyl groups, and combinations thereof, provided that said polymer does not include partially esterified copolymers of maleic anhydride or substituted maleic anhydride; and d) one or more additives selected from the group consisting of enzymes, bleaching agents, bleach activators, dye transfer inhibitors, anticorrosion materials, antistatic agents, optical brighteners, perfumes, fragrances, dyes, fillers, chelating agents, fabric whiteners, brighteners, sudsing control agents, buffering agents, soil release agents, and fabric softening agents.

2. The powder detergent composition according to claim 1 wherein the polymer is present in an amount of from about 0.5 to about 25 weight percent.

3. The powder detergent composition according to claim 1 wherein the ethylenically unsaturated hydrophilic monomer is selected from the group consisting of acrylic acid, methacrylic acid, ethacrylic acid, alpha-chloro-acrylic acid, alpha-cyano acrylic acid, beta methyl-acrylic acid (crotonic acid), alpha-phenyl acrylic acid, beta-acryloxy propionic acid, alpha-chloro sorbic acid, angelic acid, cinnamic acid, p-chloro cinnamic acid, beta-styryl acrylic acid (1-carboxy-4-phenyl butadiene-1,3), itaconic acid, maleic acid, citraconic acid, mesaconic acid, glutaconic acid, aconitic acid, fumaric acid, tricarboxy ethylene, polyethylene glycol esters of acrylic and methacrylic acid and itaconic acid, and combinations thereof.

4. The powder detergent composition according to claim 3 wherein the hydrophilic monomer is selected from the group consisting of acrylic acid, maleic acid, and itaconic acid.

5. The powder detergent composition according to claim 1 wherein the hydrophobic monomer is selected from the group consisting of styrene, α-methyl styrene, 2-ethylhexyl acrylate, 2-hydroxyethyl acrylate, octylacrylate, lauryl acrylate, stearyl acrylate, behenyl acrylate, 2-ethylhexyl methacrylate, octylmethacrylate, lauryl methacrylate, stearyl methacrylate, behenyl methacrylate, 2-ethylhexyl acrylamide, octylacrylamide, lauryl acrylamide, stearyl acrylamide, behenyl acrylamide, propyl acrylate, butyl acrylate, pentyl acrylate, hexyl acrylate, 1-vinyl naphthalene, 2-vinyl naphthalene, 3-methyl styrene, 4-propyl styrene, t-butyl styrene, 4-cyclohexyl styrene, 4-dodecyl styrene, 2-ethyl-4-benzyl styrene, 4-(phenylbutyl) styrene, and combinations thereof.

6. The powder detergent composition according to claim 5 wherein the hydrophobic monomer is styrene or lauryl methacrylate.

7. A method for cleaning textiles comprising (i) preparing a powder detergent composition according to claim 1;

(ii) contacting the powder detergent composition with one or more textiles wherein at least one of the textiles contains soil; and iii) removing at least a portion of the soil from the textile containing soil.

* * * * *